US011538610B2

(12) United States Patent
Stinshoff et al.

(10) Patent No.: US 11,538,610 B2
(45) Date of Patent: Dec. 27, 2022

(54) RARE EARTH METAL-FREE HARD MAGNETS

(71) Applicant: MAX PLANCK GESELLSCHAFT ZUR FÖRDERUNG DER WISSENSCHAFTEN EV, Munich (DE)

(72) Inventors: Rolf Stinshoff, Dresden (DE); Roshnee Sahoo, Pin (IN); Claudia Felser, Halle (DE)

(73) Assignee: MAX PLANCK GESELLSCHAFT ZUR FÖRDERUNG DER WISSENSCHAFTEN EV, Munich (DE)

( * ) Notice: Subject to any disclaimer, the term of this patent is extended or adjusted under 35 U.S.C. 154(b) by 0 days.

(21) Appl. No.: 17/055,230

(22) PCT Filed: May 8, 2019

(86) PCT No.: PCT/EP2019/061778
§ 371 (c)(1),
(2) Date: Nov. 13, 2020

(87) PCT Pub. No.: WO2019/219470
PCT Pub. Date: Nov. 21, 2019

(65) Prior Publication Data

US 2021/0257137 A1 Aug. 19, 2021

(30) Foreign Application Priority Data

May 15, 2018 (EP) ..... 18172355

(51) Int. Cl.
*H01F 1/047* (2006.01)
*H01F 1/40* (2006.01)
*H01F 10/193* (2006.01)

(52) U.S. Cl.
CPC ..... *H01F 1/047* (2013.01); *H01F 1/408* (2013.01); *H01F 10/1936* (2013.01)

(58) Field of Classification Search
None
See application file for complete search history.

(56) References Cited

U.S. PATENT DOCUMENTS 8,520,433 B1 * 8/2013 Kato ..... G11C 11/16 365/171
9,793,469 B2 * 10/2017 Kato ..... H01L 43/08
(Continued)

FOREIGN PATENT DOCUMENTS

EP 1 560 231 A2 8/2005

OTHER PUBLICATIONS

Liu et al. (IUCrJ, 2018, 5, 794-800) (Year: 2018).*
(Continued)

*Primary Examiner* — Kevin M Bernatz
(74) *Attorney, Agent, or Firm* — ProPat, LLC; Cathy R. Moore

(57) ABSTRACT

The invention relates to hard magnets that include an intermetallic compound having the general composition $X_aX'_bY_cZ_d$ where
X and X' independently from one another are representative of a 3d transition metal with unpaired electrons;
Y is a 4d or 5d transition metal of groups 5, 8, 9, or 10
Z is a main group element of groups 13, 14 or 15;
a and d independently from one another represent a number between 0.1 and 2.0; and
b and c independently from one another represent a number between 0.0 and 2.0;
such that a+b+c+d is between 3.0 and 4.0.

17 Claims, 4 Drawing Sheets

(56) References Cited

U.S. PATENT DOCUMENTS

| | | | | |
|---|---|---|---|---|
| 9,842,678 | B2 * | 12/2017 | Suzuki | C23C 14/185 |
| 10,103,321 | B2 * | 10/2018 | Kato | G11C 11/1673 |
| 2008/0253174 | A1 * | 10/2008 | Yoshikawa | H01L 43/10 365/158 |
| 2013/0236720 | A1 * | 9/2013 | Heiman | H01F 41/22 428/328 |
| 2015/0050508 | A1 * | 2/2015 | Stout | C09D 125/14 428/522 |
| 2016/0069596 | A1 * | 3/2016 | Moors | F25B 21/00 62/3.1 |
| 2017/0117074 | A1 * | 4/2017 | Suzuki | H01F 1/047 |
| 2019/0305040 | A1 * | 10/2019 | Jeong | H01F 10/30 |
| 2019/0386205 | A1 * | 12/2019 | Gosavi | H01L 43/04 |
| 2022/0028589 | A1 * | 1/2022 | Brück | F25B 21/00 |

OTHER PUBLICATIONS

Shima et al. (Automn Meeting (2015) of the Japan Institute of Metals (Year: 2015).*

Liu et al. (Appl. Phys. Lett. 109, 032408 (2016). (Year: 2016).*

Gasi et al. (Appl. Phys. Lett. 102, 202402 (2013) (Year: 2013).*

Nayak et al. (Appl. Phys. Lett. 100, 152404 (2012). (Year: 2012).*

Nayak et al. (J. Appl. Phys., 113, 17E308 (2013) (Year: 2013).*

Nayak et al. (J. Appl. Phys. 117, 17D715 (2015) (Year: 2015).*

Fichtner, Tina, et al., "Magnetic and transport properties in the Heusler series Ni2-xMn1+xSn affected by chemical disorder," Intermetallics, Nov. 7, 2014, vol. 57, pp. 101-112.

International Search Report, PCT/EP2019/061778.

Jamiyansuren, B., et al., "New Mn23P12Ga11 phase, synthesis, crystal structure and its complex phase reaction scheme," Conference: Deutsche Gesellschaft für Kristallographie, 23. Jahrestagung, Göttingen, Germany, Mar. 1, 2015, p. 1.

Zhang, L., et al. "The crystallographic phases and magentic properties of Fe2MnSi1-xGex," Physica B: Condensed Matter, May 1, 2003, vol. 328, No. 3-4, pp. 295-301.

* cited by examiner

RARE EARTH METAL-FREE HARD MAGNETS

CROSS-REFERENCE TO RELATED APPLICATIONS

This application is being filed under 35 U.S.C. § 371 as a National Stage Application of pending International Application No. PCT/EP2019/061778 filed May 8, 2019, which claims priority to the following parent application: European Patent Application No. 18172355.2, filed May 15, 2018. Both International Application No. PCT/EP2019/061778 and European Patent Application No. 18172355.2 are hereby incorporated by reference herein in their entirety.

FIELD OF THE INVENTION

The invention relates to materials with permanent magnetic properties also known as hard magnets. A good hard magnet or permanent magnet should produce a high magnetic field, should withstand external forces which would demagnetize it, and should be mechanically robust.

BACKGROUND OF THE INVENTION

Permanent magnetic materials play an important role in many areas of life, for example in medical diagnostics, magnetic circuits and in spintronics.

Typically hard magnetic materials are ferromagnetic materials which are characterized by a high remanence and high coercivity.

When a ferromagnetic material is magnetized in one direction, it will not relax to zero magnetization when the imposing magnetizing field is removed. The amount of magnetization it retains at zero imposing field is called remanence. In order to reverse the magnetization back to zero, a magnetic field in the opposite direction must be applied; the required amount of opposite magnetic field for demagnetization is called coercivity. When an alternating magnetic field is applied to the material, its magnetization will follow a loop called hysteresis loop. This hysteresis phenomenon is related to the existence of magnetic domains ("Weiss domains"). Some ferromagnetic materials will retain an imposed magnetization almost indefinitely and are, thus, useful as "permanent magnets".

Of particular significance are three intrinsic properties of the magnetic material in order to be considered as a potential permanent magnet:

- the Curie temperature ($T_C$), above which the cooperative magnetism of a ferromagnetic or ferrimagnetic material disappears,
- the saturation magnetization (Ms), which is decisive for the energy density $(BH)_{max}$, and
- the uniaxial magnetocrystalline anisotropy, which is usually represented by the anisotropy field $B_a$, which represents the upper limit of the potential coercive force of a permanent magnet.

At present, the most used high performance permanent magnets are rare earth metal compounds of samarium and cobalt (Sm—Co) and neodymium, iron and boron (Nd—Fe—B, e.g. $Nd_2Fe_{14}B$), the latter having a coercivity of about 1.2 T and a remanence of about 1.2 T and maximum energy densities of $(BH)_{max}$ of about 400 $kJm^3$. However, Dysprosium or Praseodymium is needed to improve corrosion stability and the intrinsic coercivity. These rare earth elements are "strategic materials" because of their limited resources. Their availability is subject to political constraints. Moreover, because of the susceptibility to corrosion of these materials their service temperatures are limited to below 200° C.

So far, there are no real commercial alternatives to the powerful rare earth permanent magnets, because they are superior to all previously known systems because of their magnetic properties. They have a high magnetic anisotropy, since the electrons of the f-shell are shielded from the ligand field and thus the orbital momentum of the shell shows to its advantage. In addition, they can exhibit a high localized magnetic moment, which additionally allows high saturation magnetizations.

A rare earth metal-free alternative is ferrites, which are produced on a large scale and have energy densities of typically $(BH)_{max}$<40 $kJm^{-3}$. Their use is limited to applications with low energy densities, low cost, and maximum operating temperatures of 250° C.

A further alternative are ALNICO magnets with $(BH)_{max}$ of about 80 $kJm^{-3}$ The comparatively high $(BH)_{max}$ for the rare earth metal-free alloy is due to a high remanence of about 1.1 T. Yet, the coercive field strength of $\mu_0 H_c$~0.14 T is relatively small, which means that ALNICO magnets bear the risk of irreversible losses even at small magnetic field strengths. In addition, the bulk material is very brittle and thus, mechanically fragile. However, their high operating temperatures of max. 550° C. are quite advantageous.

MnAl-based magnets currently reach a $(BH)_{max}$ of about 60 $kJm^{-3}$ with Curie temperatures of about 280° C. Their remanence and coercivity correspond to a $\mu_0 m_r$ of about 0.6 T and a $\mu_0 H_c$ of about 0.4 T. They contain no "critical" elements and are thus relatively cheap. Moreover, with a density of about 5 $gcm^{-3}$, they are also relatively lightweight, but their coercive force of ≤0.5 T is quite small.

Bulk magnets and also magnets in the form of thin films with up to $(BH)_{max}$~50 $kJm^{-3}$ can be prepared from MnBi. The hard magnetic property of MnBi is based on the uniaxial symmetry of the hexagonal crystal structure, its out-of-plane magnetization and the strong spin-orbit coupling of the heavy Bi.

Binary compounds such as CoPt or FePt which crystallize in the tetragonal structure type $L1_0$ can exhibit coercive forces of 2 T. However, the high platinum content is economically disadvantageous.

Furthermore, some Heusler compounds are known to possess hard magnetic properties. Heusler compounds are ternary intermetallic compounds of the formula $X_2YZ$, or XYZ, the latter are also known as half-Heusler compounds, wherein X and Y are usually transition metals and Z is a main group element. The class of Heusler alloys includes more than 1000 compounds which may be ferromagnetic or ferrimagnetic, although the elements from which they are made not necessarily possess this magnetic property. Members of the tetragonal family of Heusler compounds can show high magnetocrystalline anisotropy due to an inherent uniaxial symmetry. Since the tetragonal compounds are usually ferrimagnetic, they exhibit only a low saturation magnetization and therefore only a low remanence.

In addition to further development and improvement of rare earth permanent magnets, research into new systems to close the gap between ferrites and Nd—Fe—B, with $(BH)_{max}$ in the range of 100 to 300 $kJ \cdot m^{-3}$, is an important step for future technologies.

SUMMARY OF ADVANTAGEOUS EMBODIMENTS OF THE INVENTION

Therefore, it was an object of the present invention to provide hard magnetic materials which do not contain rare earth metals, but at the same time exhibit a high coercivity, high remanence and a high energy density (compared to known non-rare earth metal containing hard magnets).

The above problem is solved by rare earth metal-free ternary, intermetallic compounds with hexagonal or trigonal symmetry of the general composition $X_aX'_bY_cZ_d$, wherein X and X' is representative of a 3d transition metal with high total spin, i.e. with unpaired electrons, such as Mn, Fe, Co, Ni;

Y is a 4d or 5d transition metal of groups 5, 8, 9, or 10 such as Ru, Rh, Pd, Pt, Ir, Ag, Au, Nb or Ta which are characterized by high spin-orbit coupling (SOC);

Z is a main group element of groups 13, 14 or 15, such as Al, Ga, In, Ge, Sn, As, Sb or Bi, wherein the higher homologs (In, Sn, Sb or Bi) of these elements are also characterized by high spin-orbit coupling (SOC);

a and d represent a number between 0.1 and 2.0; and b and c represent a number between 0.0 and 2.0;

such that a+b+c+d is between 3.0 und 4.0.

Thus, in total, $X_aX'_bY_cZ_d$. represents intermetallic compounds whose compositions are between Heusler and half-Heusler compounds.

These new compounds are characterized by high uniaxial, magnetocrystalline anisotropy; thus, they are suitable for the manufacture of rare earth-free permanent magnetic materials with high coercive fields.

DETAILED DESCRIPTION OF THE INVENTION

Figure 1:
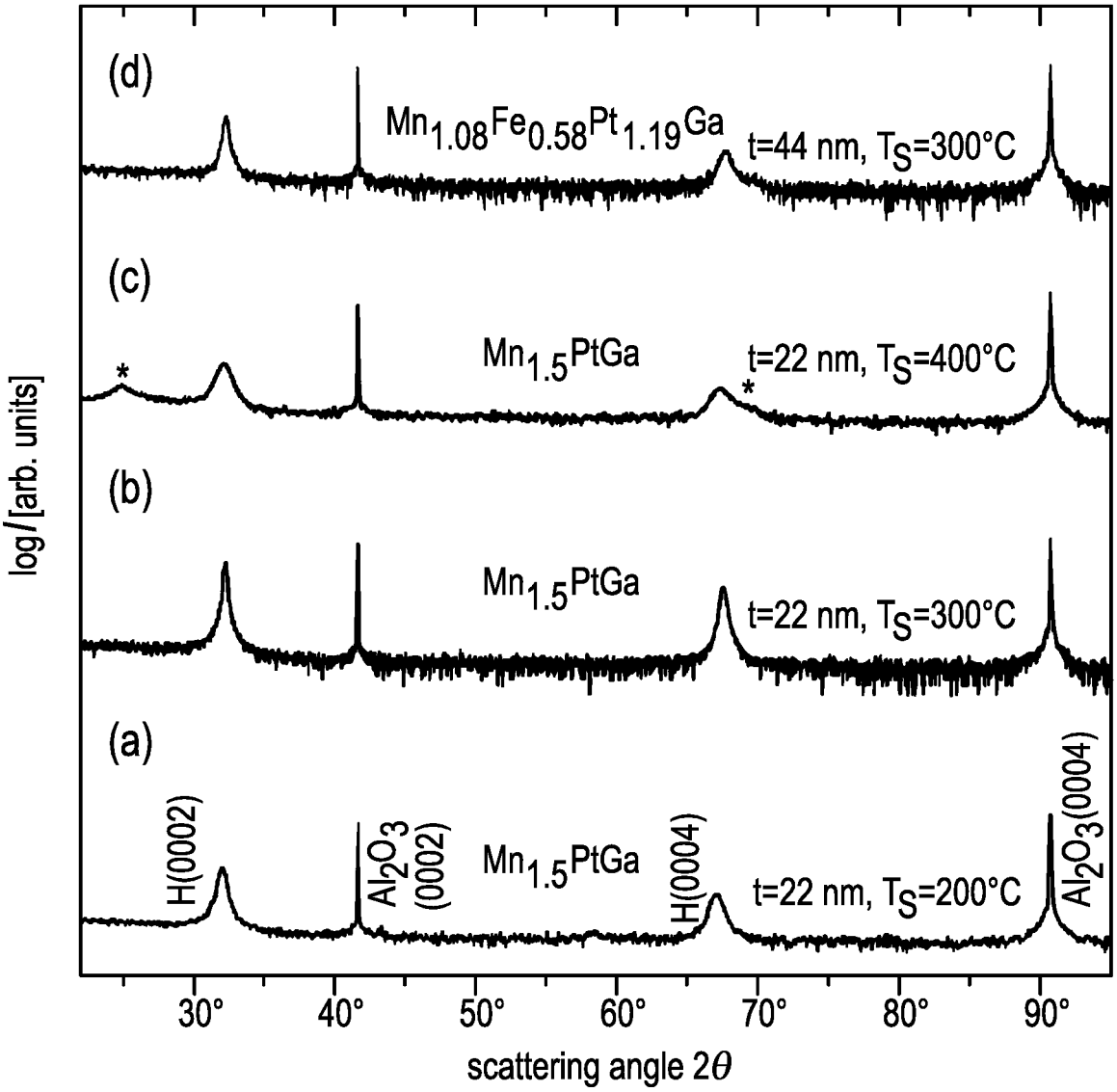
FIG. 1 shows room temperature X-ray powder diffractograms for 22 nm thin $Mn_{1.5}PtGa$ and 44 nm thin $Mn_{1.08}Fe_{0.58}Pt_{1.19}$ Ga layers grown at different temperatures on the (001) surface of a sapphire support ($Al_2O_3$): a) 200° C.; b) 300° C.; c) 400° C.; d) 300° C.
Figure 2A:
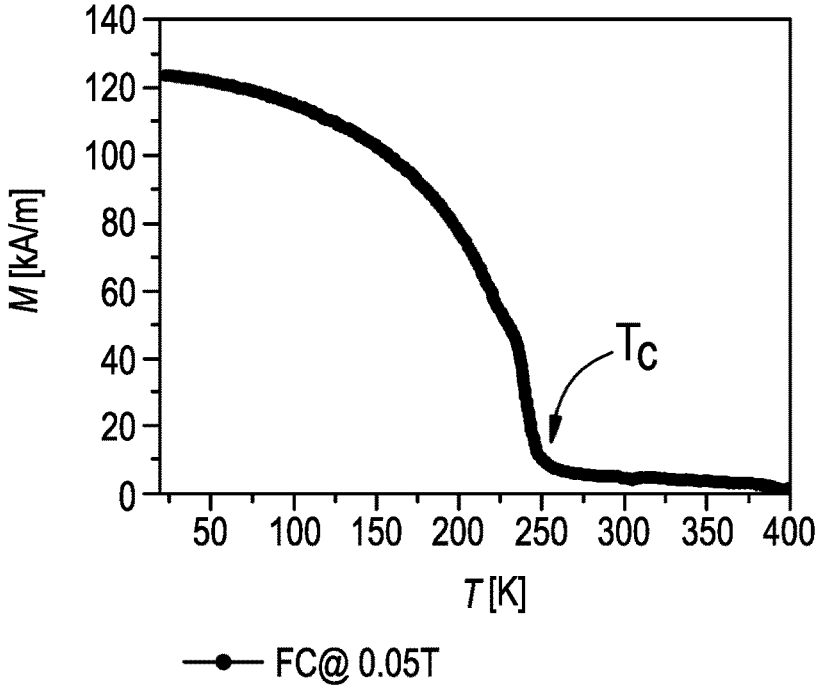
FIG. 2A shows a) the temperature dependence of the magnetization on cooling and at 0.05 T for a thin layer of $Mn_{1.5}PtGa$ on sapphire (001) as substrate.
Figure 2B:
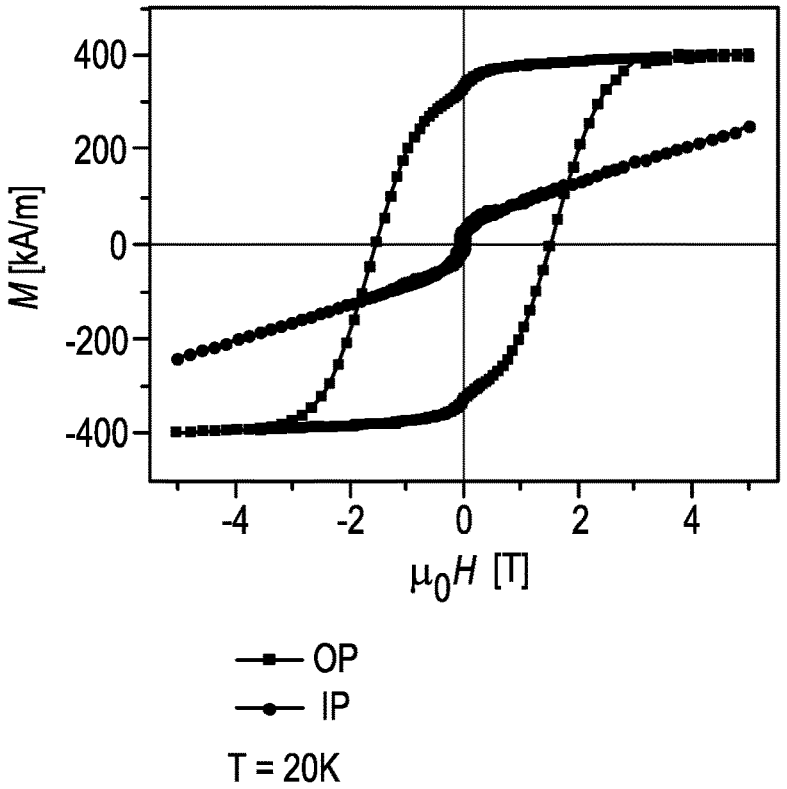
FIG. 2B shows b) out-of-plane (OP) and in-plane (IP) hysteresis curves at 20 K for a thin layer of $Mn_{1.5}PtGa$ on sapphire (001) as substrate.
Figure 2C:
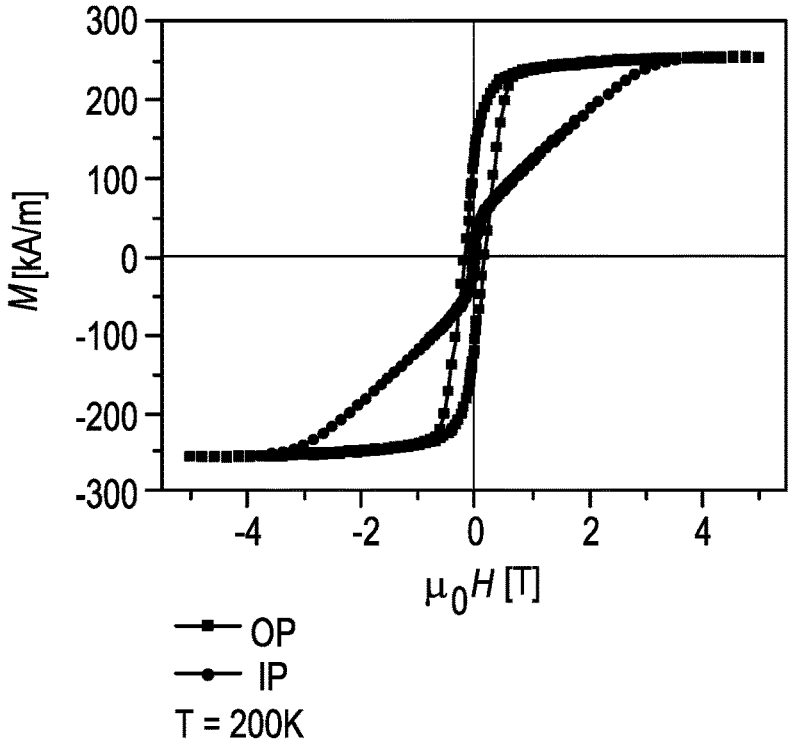
FIG. 2C shows e) out-of-plane (OP) and in-plane (IP) hysteresis curves at 200 K for a thin layer of $Mn_{1.5}$ PtGa on sapphire (001) as substrate.
Figure 2D:
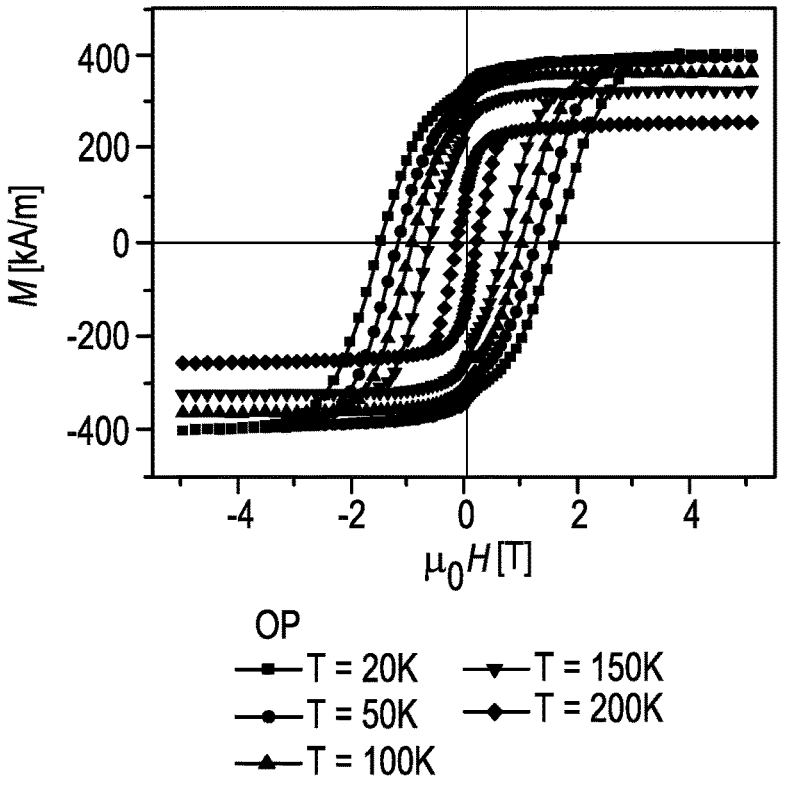
FIG. 2D shows e) out-of-plane hysteresis curves of a 22 nm thin $Mn_{1.5}PtGa$ layer deposited on the sapphire substrate at various temperatures (20, 50, 100, 150 and 200 K)

The ternary, intermetallic compounds according to the present invention possess a hexagonal or trigonal crystal structure. This is an important feature since crystal structures of this symmetry fulfill the criterion of crystalline anisotropy due to an inherent uniaxial symmetry. In the compounds of the present invention this crystalline anisotropy combines with the pronounced spin-orbit coupling of the 4*d* and 5*d* elements (transition metal or main group element). As a consequence of this, these compounds exhibit strong magnetic anisotropy even in the absence of shape anisotropy due to the magnetocrystalline anisotropy.

The intermetallic compounds of the present invention have the general composition $X_aX'_bY_cZ_d$ and are, thus, composition-wise located between Heusler and half-Heusler compounds.

Heusler compounds are intermetallic compounds of the general composition $X_2YZ$ and crystallize in the L21-structure type (Pearson's Handbook of Crystallographic Data for Intermetallic Phases, ASM International, The Materials Information Society, 1991). Intermetallic compounds in general are compounds a) between two or more true metals (T1 and T2)

b) between one or more true metals and one or more true metals of the B subgroup c) between two or more metals of the B subgroup The properties of these compounds become less metallic and increasingly similar to real chemical compounds when moving from a) to c). The classification into true metals and elements of the B subgroups is taken from Table 13.1 from R. C. Evans (Introduction to Crystal Chemistry, Walter de Gruyter Verlag Berlin New York 1976 p. 276):

| True metals | | | | | | | | | | | Elements of the B-group | | | | |
|---|---|---|---|---|---|---|---|---|---|---|---|---|---|---|---|
| $T_1$ | | $T_2$ | | | | | | | | | $B_1$ | | $B_2$ | | |
| Li | Be | | | | | | | | | | | | | | |
| Na | Mg | | | | | | | | | | | Al | Si | | S |
| K | Ca | Sc | Ti | V | Cr | Mn | Fe | Co | Ni | Cu | Zn | Ga | Ge | As | Se |
| Rb | Sr | Y | Zr | Nb | Mo | Tc | Ru | Rh | Pd | Ag | Cd | In | Sn | Sb | Te |
| Cs | Ba | La | Hf | Ta | W | Re | Os | Ir | Pt | Au | Hg | Tl | Pb | Bi | Po |

The metals of the lanthanide and actinide series belong to class T2. In the Heusler compounds $X_2YZ$, X and Y are predominantly transition metal elements (T2 in the table above), sometimes Y is also a rare earth element. Z is a nonmagnetic metal or a nonmetal (B1 or B2).

The intermetallic compounds of the present invention have the general composition $X_aX'_bY_cZ_d$. In these Heusler and half-Heusler compounds respectively X and X' is representative of a 3d transition metal with high total spin, i.e. with unpaired electrons, preferably Mn, Fe, Co or Ni;

Y is a 4d or 5d transition metal of groups 5, 8, 9, or 10 which metals are characterized by high spin-orbit coupling (SOC), preferably Ru, Rh, Pd, Pt, Ir, Ag, Au, Nb or Ta;

Z is a main group element of groups 13, 14 or 15, preferably Al, Ga, In, Ge, Sn, As, Sb or Bi, wherein the higher homologs (In, Sn, Sb or Bi) of these elements are also characterized by high spin-orbit coupling (SOC);

a and d represent a number between 0.1 and 2.0; and b and c represent a number between 0.0 and 2.0; such that a+b+c+d is between 3.0 und 4.0.

In the Heusler compounds of the present invention the parameters a, b, c and d can independently be chosen from numbers between 0.1 and 2.0 (for a and d) and between 0.0 and 2.0 (for b and c). Preferably a is 1 or 2, more preferably a is 1 when b is 1 and a is 2 when b is 0. Preferably d is 1. Preferably b is either 0 or—when a is 1—b is preferably 1. Preferably c is 1.

In general the sum of a, b, c, and d is between 3.0 and 4.0, preferably either 3.0 or 4.0.

Method of Manufacture

For the manufacture of the compounds of the present invention the sputtering technique is used. This allows the manufacture of thin layers (films) of the compounds. For this purpose elemental metals and/or alloys of two metals are used as targets in sputtering. The base pressure of the vacuum receiver is preferably $\leq 10^{-6}$ mbar, more preferably $\leq 10^{-7}$ mbar and most preferred $\leq 10^{-8}$ mbar and the deposition preferably takes place at $0.1\times10^{-3}$ mbar to $10\times10^{-3}$ mbar, more preferred at $1\times10^{-3}$ mbar to $5\times10^{-3}$ mbar, and most preferred at $3\times10^{-3}$ mbar within a preferred temperature range of 100° C. to 500° C., more preferred 150° C. to 450° C. and most preferred 200° C. to 400° C. The growth rate of the thin layers is about 0.03 to 0.04 nm/s. After deposition, the thin layers on the substrate within the recipient are preferably vacuum annealed for preferably 5 to 25 minutes, more preferred 10 to 20 minutes and most preferred for about 15 minutes and then slowly cooled to room temperature. Then preferably a protective layer of 2 to 3 nm aluminum is deposited to pre-coat the thin metal layers to protect them from oxidation.

The crystal structure of the deposited material can be influenced by varying the deposition parameters. It was found that at low deposition temperatures of about 200° C. the hexagonal structure is preferentially formed while with increasing temperature (at about 400° C.) the proportion of the tetragonal half-Heusler compound increases. In a further preferred embodiment the compounds can be obtained by epitaxial growth of the thin films on a predefined substrate with the desired crystal structure, e.g. sapphire substrates (along 0001) or on MgO (along 001) as a substrate. It was observed that the hexagonal compounds of the present invention grow on sapphire preferentially with the crystallographic [001] direction perpendicular to the substrate surface. In principle, hexagonal Ru or Co can also be used as the substrate surface. However, these substrates have high lattice mismatch compared to the hexagonal compounds of the present invention and are, therefore, less preferred. A further, but also less preferred alternative is hexagonal SiC (2H) and trigonal $SiO_2$ as a substrate; thin layers grown on these types of substrate showed poorer crystallinity.

Manufacture of Magnets for Use

For use as a magnet the compounds of the present invention can e.g. be sintered as raw material or bonded with an appropriate binder material. Sintered magnets are usually stronger and anisotropic but shapes are limited. They are made by pressure forming the raw materials followed by a heating process. Bonded magnets are less strong as sintered ones but less expensive and can be made into almost any size and shape. For bonded magnets the raw materials (compounds according to the invention) are mixed with 5 to 90 wt.-%, preferably 10 to 60 wt.-%, more preferably 20-40 wt.-% binder, compacted and cured at elevated temperature (e.g. at 50-350° C., preferably at 80-280° C., more preferably at 100-200° C.; depending on the binder used and the temperature stability of the magnetic compound). They are isotropic, i.e. they can be magnetized in any direction. The molding process can e.g. be an injection molding or a compression bonding process. Typical binder types are Nylon, Polyamide, Polyphenylene sulfide (PPS) and Nitrile Butadiene Rubber (NBR)).

EXAMPLES

Equipment and Measuring Methods

The crystal structure and thickness of the films was examined by means of X-ray diffraction (XRD) measurements using a Cu-$K_\alpha$ source (Philips PANanalytical X'pert Pro). Energy-dispersive X-ray spectroscopy (EDX) measurements were performed on a QUANTA 200 FEG I in order to determine the composition of the films. The StrataGEM software package was used to obtain the film thickness. A Quantum Design superconducting quantum interference device vibrating sample magnetometer (MPMS-3) was used to study the magnetic properties of the thin films.

Example 1 and 2

$Mn_{1.5}PtGa$ and $Mn_{1.08}Fe_{0.58}Pt_{1.19}Ga$

Thin layers of $Mn_{1.5}PtGa$ and $Mn_{1.08}Fe_{0.58}Pt_{1.19}Ga$ were prepared by epitaxial growth on a sapphire surface (0001) as a substrate. Since sapphire ($Al_2O_3$) crystallizes in the trigonal crystal system, i.e. with hexagonal metric, the structure of the sapphire surface supports epitaxial growth of the $Mn_{1.5}PtGa$ and $Mn_{1.08}Fe_{0.58}Pt_{1.19}Ga$ layers.

Elemental manganese, platinum, iron and alloys of the composition MnGa were used as targets for sputtering. The base pressure of the vacuum receiver was <10-8 mbar, and the deposition on the substrate took place at $3\times10^3$ mbar within a temperature range of 200° C. to 300° C. The growth rate of the thin layers was about 0.03 to 0.04 nm/s. After deposition, the thin layers on the substrate within the recipient were vacuum annealed for 15 minutes and then slowly cooled to room temperature. Then a protective layer of 2 to 3 nm aluminum was deposited to protect the thin metal layers from oxidation.

X-ray powder diffractograms at room temperature in "out-of-plane" geometry on a 22 nm thin layer of $Mn_{1.5}PtGa$ and a 44 nm thin layer of $Mn_{1.08}Fe_{0.58}Pt_{1.19}Ga$ are shown in FIG. 1. The Bragg reflections of the hexagonal structure are labeled H(0002) and H(0004). The thin layer grown at 300° C. (FIG. 1 *b*) shows better crystallinity compared to a layer applied at 200° C. (FIG. 1 *a*). At deposition temperatures above 300° C. (FIG. 1 *c*), a decrease in Bragg intensities and additional weak reflections are observed (marked with *). It can be assumed that the additional reflections are caused by a tetragonal half-Heusler compound as a secondary phase. Similar behavior is also observed in bulk samples. Substitution of part of the Mn by Fe preserves the hexagonal structure as shown in FIG. 1*d*. All thin films deposited on sapphire (0001) exhibit texture regardless of the temperature of the deposition. The epitaxial growth on the surface of the trigonal substrate causes hexagonal $Mn_{1.5}PtGa$ and $Mn_{1.08}Fe_{0.58}Pt_{1.19}Ga$, respectively, to be deposited with preferential orientation of the crystallographic [001] direction perpendicular to the surface of the substrate and thus parallel to the crystallographic c-axis of the sapphire.

The crystal structure of the deposited material can be influenced by means of different deposition parameters. It is observed that at low deposition temperatures the hexagonal structure is preferentially formed while with increasing temperature the proportion of the tetragonal half-Heusler compound increases. The lattice parameters of the hexagonal crystal structure are a=4.35 Å and c=5.58 Å for $Mn_{1.5}PtGa$ and a=4.33 Å and c=5.52 Å for $Mn_{1.08}Fe_{0.58}Pt_{1.19}Ga$. This corresponds to a lattice mismatch of the a-axis of about 8.2% and 8.6% relative to the a-axis a=4.74 Å of the sapphire substrate. Despite the relatively large lattice mismatch, epitaxial growth of $Mn_{1.5}PtGa$ and $Mn_{1.08}Fe_{0.58}Pt_{1.19}Ga$ is observed on the sapphire surface (0001) of the substrate.

The magnetic properties of a well-crystalline thin layer of $Mn_{1.5}PtGa$ deposited on a sapphire (0001) surface at 300° C. are shown in FIG. 2. FIG. 2*a* illustrates the magnetization measured in field-cooled mode (FC) at a field strength of 0.05 T as a function of temperature. At a Curie temperature (Tc) of about 241 K, a ferromagnetic to paramagnetic phase transition is observed. The corresponding M(H) curves for 20 K and 200 K are shown for "in-plane" (IP) and "out-of-plane" (OP) directions in FIGS. 2*b* and 2*c*, respectively. The data shown correspond to the raw data after deduction of the substrate contribution for the respective temperatures. The sample shows a coercive field strength, $H_c$ of 1.5 T in "out-of-plane" orientation at 20 K, yet, only a nearly vanishing coercivity (0.18 T) at 200 K (due to the temperature dependency of the magnetic anisotropy). FIG. 2*d* shows a systematic decrease in coercivity with increasing temperature. The measured value of the coercive force in the "out-of-plane" direction shows the strong magnetic anisotropy compared to the "in-plane" measurement. At 20 K and 5 T, a total magnetization of 400 kA/m is measured. This results in 3.3 $MJ/m^3$ as the value of the anisotropy constant ($K_U$) according to the equation $K_U=(\mu_0 M_S \times H_a)/2$. $M_S$ is the saturation magnetization and $H_a$ is the anisotropy field. An estimate of the latter is obtained by using the intersection point of "in-plane" and "out-of-plane" plots. The thin layers of $Mn_{1.5}PtGa$ show a $(BH)_{max}$ of about 30 $kJm^{-3}$ at 20 K. As the temperature increases, $(BH)_{max}$ decreases, and at 200 K, i.e. near the Curie temperature, it is only 4 $kJm^3$.

Figure 3A:
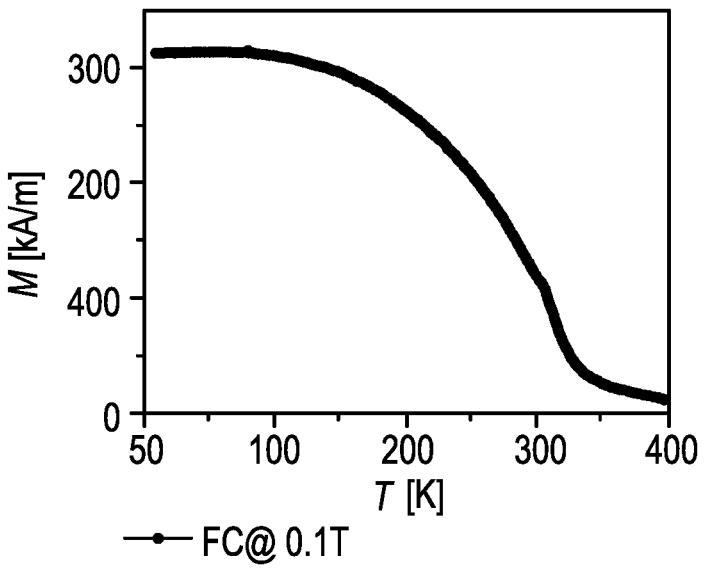
FIG. 3A shows the temperature dependency of the magnetization on cooling in an external magnetic field of 0.1T for a $Mn_{1.08}Fe_{0.58}Pt_{1.19}Ga$ thin layer of 44 nm thickness, which was applied at 300° C. on a sapphire (001) carrier.
Figure 3B:
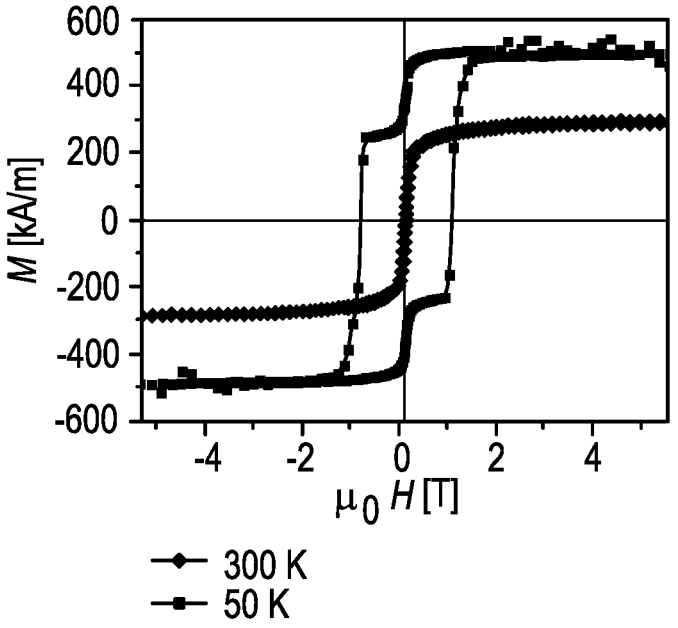
FIG. 3B shows an out-of-plane (OP) hysteresis curve at 50 K and 300 K for a $Mn_{1.08}Fe_{0.58}$ $Pt_{1.19}Ga$ thin layer of 44 nm thickness which was applied at 300° C. on a sapphire (001) carrier.

FIG. 3 shows the magnetization for a 44 nm thin film of $Mn_{1.08}Fe_{0.58}Pt_{1.9}Ga$ that was deposited at 300° C. A magnetization measured in field-cooled mode (FC) at a field strength of 0.1 T as a function of temperature (FIG. 3*a*) shows a ferromagnetic to paramagnetic phase transition at about 312 K. Hysteresis curves measured in out-of-plane geometry at 50 and 300 K, respectively, are shown in FIG. 3*b*. The low temperature measurement shows a coercive field strength of 0.87 T while that of the measurement near $T_C$ is 0.02 T.

Both examples illustrate that materials with hexagonal crystal structure can exhibit significant coercivities and remanences in the presence of elements with sufficient unpaired electrons, such as manganese or iron, and elements with pronounced spin-orbit coupling, such as platinum. The hexagonal $Mn_{1.08}Fe_{0.58}Pt_{1.19}Ga$ system also shows that both the Curie temperature and the magnetic moment can be further increased in quaternary systems. Similar results can also be achieved in the MnCoPtGa system.

The invention claimed is:

1. A hard magnet comprising an intermetallic compound having the general composition $$X_aX'_bY_cZ_d$$

wherein

X and X' independently from one another are representative of a 3d transition metal with unpaired electrons;

Y is a 4d or 5d transition metal of groups 5, 8, 9, or 10;

Z is a main group element of groups 13, 14 or 15;

a and d independently from one another represent a number between 0.1 and 2.0;

b represents a number between 0.0 and 2.0; and c is 1;

and a+b+c+d is between 3.0 und 4.0;

the intermetallic compound has hexagonal or trigonal crystal symmetry;

and the hard magnet has a coercivity $B_c$ of ≥0.05 T.

2. The hard magnet according to claim 1, wherein X and X' is independently selected from Mn, Fe, Co or Ni.

3. The hard magnet according to claim 1, wherein Y is Ru, Rh, Pd, Pt, Ir, Ag, Au, Nb or Ta.

4. The hard magnet according to claim 1, wherein Z is Al, Ga, In, Ge, Sn, As, Sb or Bi.

5. The hard magnet according to claim 1, wherein a is 1 or 2.

6. The hard magnet according to claim 5, wherein a is 1 when b is 1, and a is 2 when b is 0.

7. The hard magnet according to claim 1, wherein d is 1.

8. The hard magnet according to claim 1, wherein b is either 0 or when a is 1 then b is 1.

9. The hard magnet according to claim 1, wherein the sum of a, b, c, and d is either 3.0 or 4.0.

10. The hard magnet according to claim 1, wherein the intermetallic compound has magnetocrystalline anisotropy.

11. The hard magnet according to claim 1, wherein the hard magnet is sintered.

12. The hard magnet according to claim 1, wherein the hard magnet further comprises a binder.

13. The hard magnet according to claim 1, wherein b is not 0.

14. A method of making a hard magnet comprising either sintering or incorporating an intermetallic compound into a binder, said intermetallic compound having the general composition $$X_aX'_bY_cZ_d$$

wherein

X and X' is representative of a 3d transition metal with unpaired electrons;

Y is a 4d or 5d transition metal of groups 5, 8, 9, or 10

Z is a main group element of groups 13, 14 or 15;

a and d independently from one another represent a number between 0.1 and 2.0; and b and c independently from one another represent a number between 0.0 and 2.0;

and a+b+c+d is between 3.0 und 4.0, and the method further comprises depositing the intermetallic compound on a sapphire or MgO substrate at a deposition temperature that results in a hexagonal or trigonal crystal symmetry.

15. A hard magnet comprising an intermetallic compound having the general composition $$X_aX'_bY_cZ_d$$

wherein

X and X' independently from one another are representative of a 3d transition metal with unpaired electrons;

Y is Ru, Rh, Pd, Pt, Ir, Ag or Au;

Z is a main group element of groups 13, 14 or 15;

a and d independently from one another represent a number between 0.1 and 2.0;

b represents a number between 0.0 and 2.0; but is not 0.0 and c is 1;

and a+b+c+d is between 3.0 und 4.0, and the intermetallic compound has hexagonal or trigonal crystal symmetry.

16. A material with permanent magnetic properties comprising (i) a hard magnet comprising an intermetallic compound having the general composition $$X_aX'_bY_cZ_d$$

wherein

X and X' independently from one another are representative of a 3d transition metal with unpaired electrons;

Y is a 4d or 5d transition metal of groups 5, 8, 9, or 10

Z is a main group element of groups 13, 14 or 15;

a and d independently from one another represent a number between 0.1 and 2.0;

b represents a number between 0.0 and 2.0; and c is 1;

and a+b+c+d is between 3.0 und 4.0, disposed on (ii) an epitaxial substrate selected from sapphire or MgO, and the intermetallic compound has hexagonal or trigonal crystal symmetry.

17. The material according to claim 16, wherein said hard magnet is $Mn_{1.5}PtGa$ or $Mn_{1.08}Fe_{0.58}Pt_{1.19}Ga$ and the substrate is sapphire.

* * * * *